US005133259A

United States Patent [19]

Schluckebier

[11] Patent Number: 5,133,259

[45] Date of Patent: Jul. 28, 1992

[54] SEAL RING FOR PYROTECHNICALLY INITIATED PROJECTILE

[75] Inventor: David K. Schluckebier, Florissant, Mo.

[73] Assignee: Olin Corporation, Cheshire, Conn.

[21] Appl. No.: 537,190

[22] Filed: Jun. 12, 1990

Related U.S. Application Data

[63] Continuation-in-part of Ser. No. 528,009, May 23, 1990, abandoned.

[51] Int. Cl.[5] ..... F42B 12/44

[52] U.S. Cl. ..... 102/364; 102/473; 102/478; 102/479

[58] Field of Search ..... 102/364, 365, 473, 478, 102/479, 513-518; 86/20.14; 29/1.2, 1.21, 1.22, 1.23; 277/212 R, 212 C; 285/110; 166/202

[56] References Cited

U.S. PATENT DOCUMENTS

| | | | |
|---|---|---|---|
| 47,544 | 5/1865 | Hotchkiss . | |
| 373,459 | 11/1887 | Howell . | |
| 382,223 | 5/1888 | Graydon . | |
| 3,208,385 | 9/1965 | Perniss | 102/364 |
| 3,720,169 | 3/1973 | Johnson et al. . | |
| 4,045,055 | 8/1977 | Blakely | 285/110 |
| 4,353,302 | 10/1982 | Strandli et al. . | |
| 4,625,650 | 12/1986 | Bilsbury . | |
| 4,760,795 | 8/1988 | Young | 102/473 |
| 4,876,964 | 10/1989 | Strandli et al. . | |

FOREIGN PATENT DOCUMENTS

| | | | |
|---|---|---|---|
| 1131561 | 6/1962 | Fed. Rep. of Germany | 102/513 |

*Primary Examiner*—Harold J. Tudor
*Attorney, Agent, or Firm*—John R. Wahl

[57] ABSTRACT

A pyrotechnically initiated explosive projectile has coaxially arranged, a nose incendiary, a penetrator core, a high explosive, and an overall jacket. A seal ring is installed between the nose incendiary and the penetrator core to preclude relative movement between the core and the jacket during projectile assembly, acceleration and spin up from prematurely igniting the incendiary charge. The seal ring has a front collar portion which preferably has a diameter greater than that of the inside diameter of the jacket so that the collar scrapes the inside wall of the jacket during insertion to remove incendiary residual so that no incendiary can lodge between the jacket and the penetrator core.

29 Claims, 2 Drawing Sheets

SEAL RING FOR PYROTECHNICALLY INITIATED PROJECTILE

This application is a continuation-in-part of my application, Ser. No. 528,009 filed May 23, 1990, now abandoned.

BACKGROUND AND SUMMARY OF THE INVENTION

This invention generally relates to projectiles having explosive charges therein and more particularly to a pyrotechnically initiatied explosive (PIE) projectile which is ignited by a pyrotechnic incendiary charge located in the nose of the projectile. More specifically, the invention relates to a barrier which prevents preignition of the pyrotechnic charge from relative frictional movement between the projectile components.

The potential for premature ignition of incendiary or explosives contained in projectiles during handling and/or acceleration has long been recognized. Various attempts to alleviate this problem are exemplified by the following U.S. patents.

U.S. Pat. No. 47,544 to Hotchkiss discloses an explosive ordnance shell having transverse ribs to partition the explosive charge so as to limit friction between the shell contents during spin up.

U.S. Pat. No. 373,459 to Howell also discloses an explosive shell having transverse diaphrams between and separating the explosive charge.

U.S. Pat. No. 383,223 to Graydon discloses an explosive shell containing separated explosive charges. The charges are separated by transverse partitions which also may have perforations to conduct the flame between the charges.

U.S. Pat. No. 3,720,169 to Johnson et al discloses a projectile having two nose incendiary charges separated from one another by a partition disk.

U.S. Pat. No. 4,876,964 to Strandli et al discloses an incendiary containing projectile which has an interior coating or lining to prevent inadvertant ignition of the incendiary if the projectile is dropped.

Several designs of PIE projectiles have been developed in recent years for small caliber ammunition with varying degrees of success. One such projectile is disclosed in U.S. Pat. No. 4,625,650, assigned to the assignee of the present invention. This copper jacketed explosive bullet for penetrating light armor has an inner tubular hard heavy metal penetrator body filled with a high explosive. It has a nose portion forward of the penetrator which is filled with an incendiary material. The incendiary is designed to ignite upon target impact, in turn igniting the explosive after penetrating light armor. Around the outside of the penetrator and nose portion is an outer copper jacket which forms the final aerodynamic shape of the bullet.

Another PIE projectile is disclosed in U.S. Pat. No. 4,353,302. This patent discloses a projectile having a tubular steel body filled with explosive and also having a nose filled with an incendiary ignition material. Also within the tubular body is a subcaliber, solid tungsten penetrator core for the penetration of light armor.

During spin-up of these types of projectiles in the weapon bore, there is some relative movement between the jacket and the tubular body. This movement may result in premature ignition of the incendiary material and the explosive in the weapon bore which is highly undesirable.

The cause of the preignition is not the relative movement per se. It is due to the presence of small amounts of incendiary material between the jacket and the tubular body at the location of relative movement. The incendiary material may frictionally cling to the jacket sidewall as a result of the charging operation. Under assembly pressures, the material may also flow into undesired locations where normal part tolerances provide an opening. The friction from relative movement, occuring during spin-up, ignites this small amount of incendiary which in turn ignites the main incendiary and/or explosive charge.

The present invention prevents preignition by providing a flexible seal ring partition between the tubular body and the jacket where the incendiary joins with the tubular body and the jacket, and by designing the seal ring to scrape the inner wall of the jacket during installation to remove residual incendiary material from the wall of the jacket. Thus there is no residual incendiary material on the jacket wall when the tubular body is installed in the jacket. Further, the shape of the seal ring tends to guide itself during insertion into the jacket to ensure coaxial alignment of the seal ring with the jacket.

The seal ring of the present invention comprises a ring shaped plastic body generally symmetrical about a central axis. The body has an outwardly flared front collar portion and an outwardly flared rear skirt portion which are integrally joined to a central tubular portion. The central portion has an inwardly projecting curved lip protruding inward toward the central axis. The curved lip has a smooth concave surface oriented forwardly toward the projectile nose.

The seal ring is designed to be installed within the jacket after the incendiary material is deposited in the nose end of the jacket and prior to the insertion of the tubular hard metal body containing the high explosive. The seal ring is sized so as to frictionally fit into the projectile jacket. The front collar portion is sufficiently large in diameter so that it is constricted during insertion within the jacket to scrape or swab along the inner wall of the jacket to remove any incendiary material which has adhered to the inner wall. Thus, all of the residual incendiary is moved to the forward, proper location during component assembly. The front collar portion is also short enough in length so that the material of the collar does not wrinkle when it conforms to the inner wall of the jacket.

The rear skirt portion is sized slightly larger in diameter than the front collar portion so as to act like a shuttle cock during seal insertion. This keeps the seal in proper axial alignment. The rear portion is also segmented or provided with cutout portions to avoid wrinkling when it is constricted during insertion. The rear portion is sized to fit over the front end of the tubular body and is ultimately swaged between the tubular metal body and the jacket to seal this interface.

Finally, a central bore through the seal ring permits an incendiary interface with the high explosive charge to maintain continuity of the explosive train. The size of this bore may be varied to control the detonation efficiency by providing greater confinement of the high explosive.

Other objects, features and advantages of the invention will become more apparent from consideration of the following detailed description when taken in conjunction with the drawing and appended claims.

DETAILED DESCRIPTION OF THE INVENTION

Figure 1:
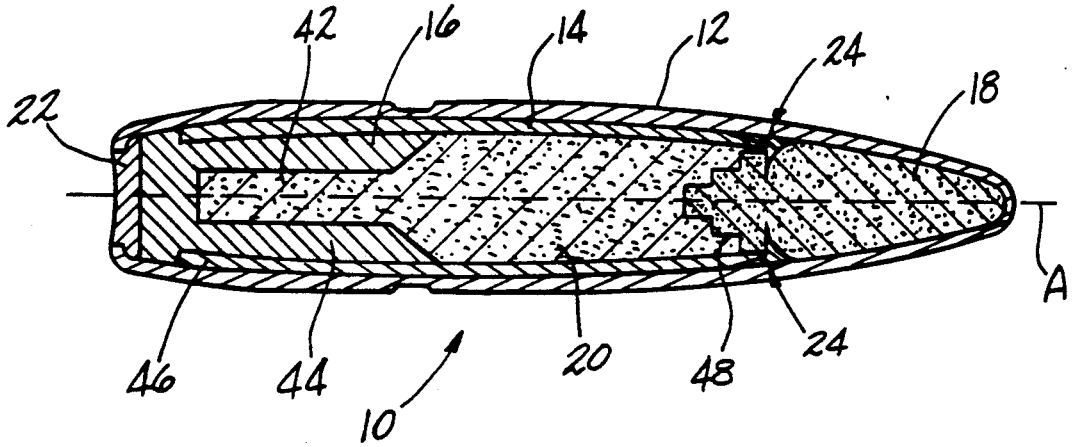
FIG. 1 is a longitudinal sectional view of a PIE projectile incorporating one preferred embodiment of the seal ring in accordance with the present invention.

A PIE projectile 10, shown in FIG. 1, preferably comprises a copper/zinc jacket 12, a hard metal tubular penetrator body 14 coaxially within the jacket 12, a base plug 16 closing the rear of the penetrator 14, a nose incendiary 18 in front of the penetrator 14, and a high explosive 20 packed within the penetrator 14. Behind the base plug 16 is a lead seal 22.

The penetrator 14 is preferably a tungsten alloy tubular body having the shape of a hollow cylinder tapered front and rear. The penetrator 14 is preferably filled with a plasticised high explosive 20 which is designed to fragment the tubular penetrator 14 upon detonation. The high explosive is preferably sufficient to fill at least 80% of the internal volume defined by the internal wall of the penetrator body. The nose incendiary 18 is located immediately forward of the high explosive 20 and can project either partly within penetrator 14 as shown in FIG. 1 or reside wholly forward of penetrator 14. The nose incendiary 18 is designed to ignite when the projectile 10 impacts a target at a sufficient velocity and to thereby ignite the high explosive 20 after a sufficient amount of delay time for the penetrator 14 to pass through at least an initial layer of target material. Accordingly, the high explosive will detonate and fragment the penetrator 14 behind the initial target layer.

Figure 2:
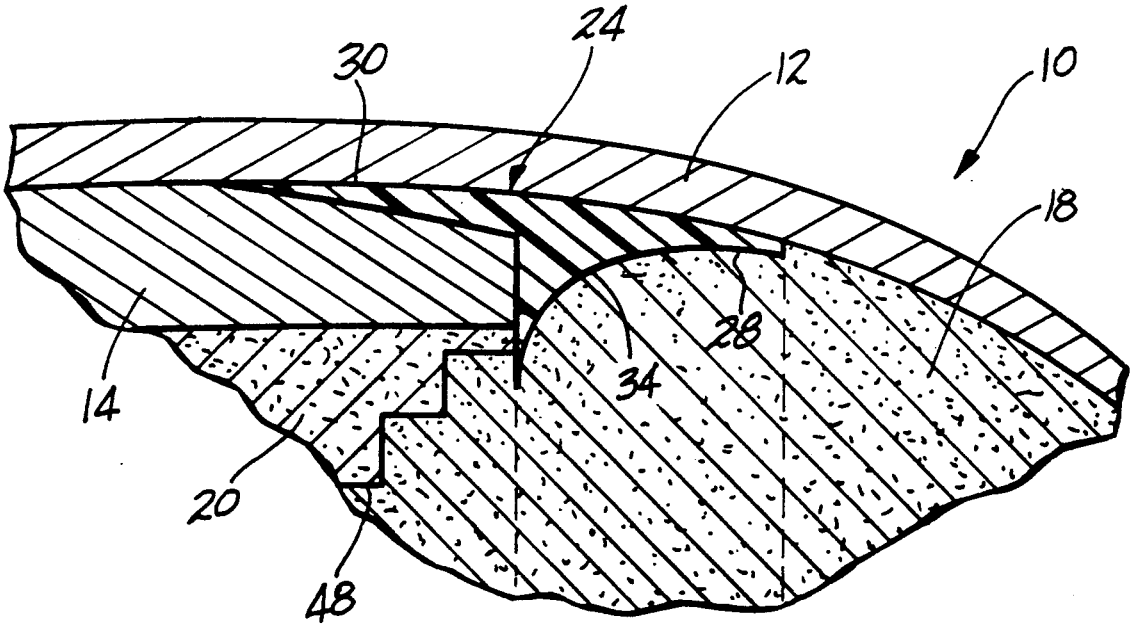
FIG. 2 is an enlarged view of a portion of the projectile in FIG. 1.
Figure 3:
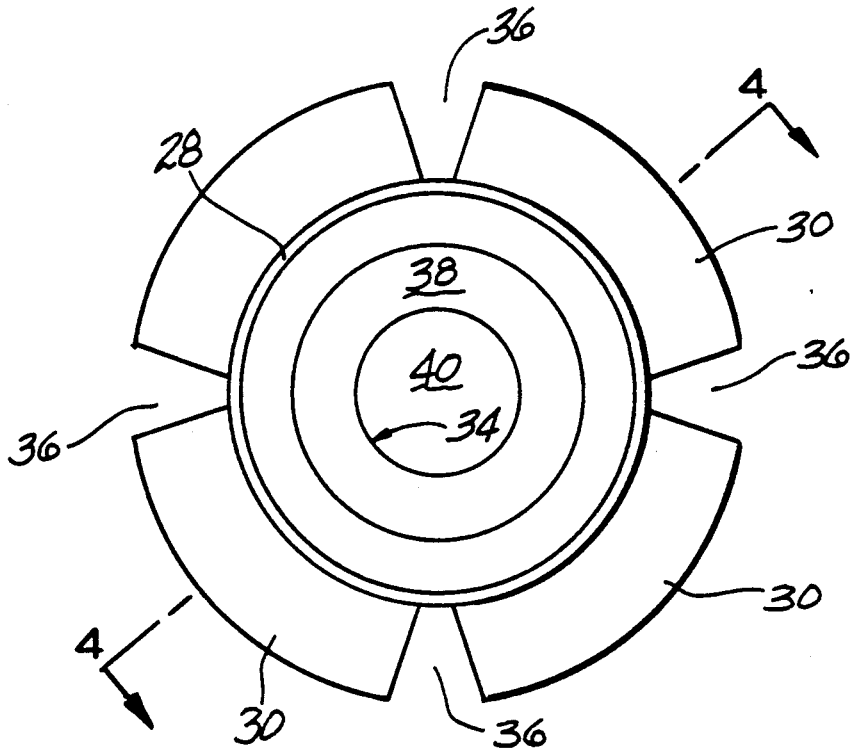
FIG. 3 is a separate rear end view of the seal ring shown prior to insertion into the projectile of FIG. 1.
Figure 4:
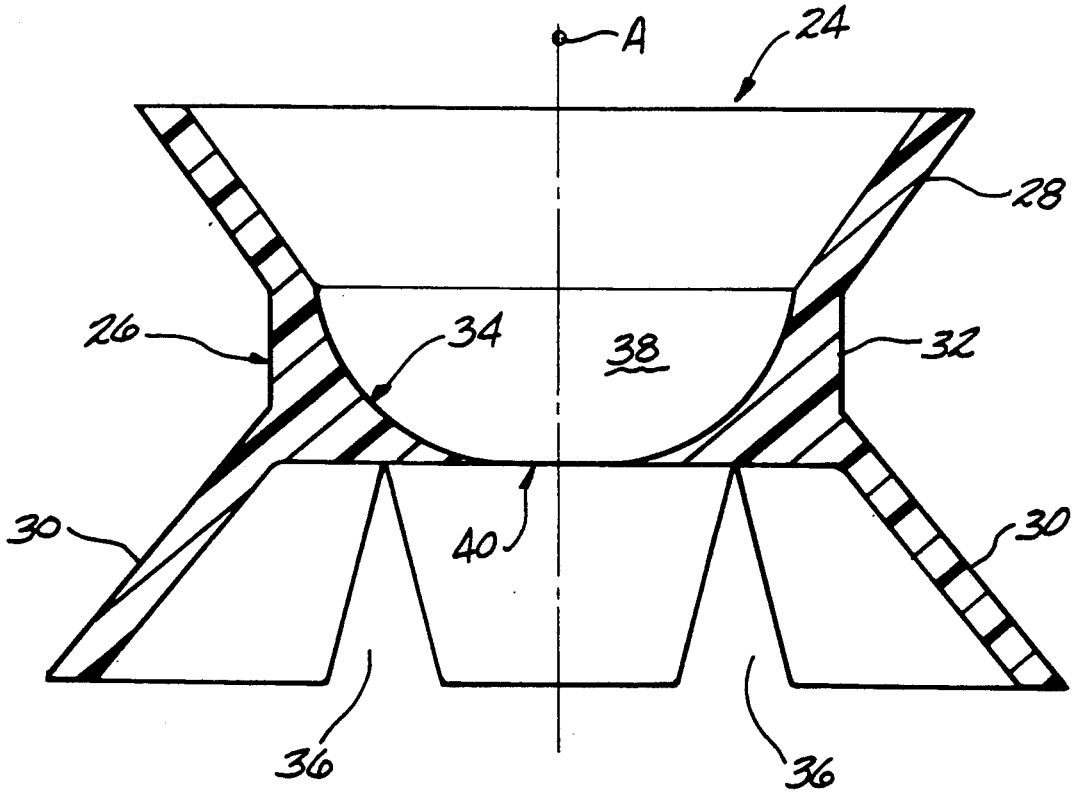
FIG. 4 is a sectional view of the seal ring taken on the line 4—4 in FIG. 3.

To preclude preignition and inbore detonations of the explosive 20, a seal means is installed which precludes incendiary material from being trapped between the penetrator 14 and the inner wall surface of the copper jacket 12. This seal means, a flexible, generally circular seal ring 24 in accordance with the present invention, is installed between the penetrator 14 and the nose incendiary 18. It comprises a generally ring shaped body 26 which is inwardly compressible, outwardly resiliantly biased and which is symmetrical about a central longitudinal axis A. The body 26 has an outwardly flared front collar portion 28 and an outwardly flared rear skirt portion 30 which are integrally joined to a central ring portion 32. The central portion 32 has an inwardly projecting curved lip 34 protruding from its inner side toward the central axis. As shown in FIG. 2, the curved lip 34 is designed to form a smooth, curved forwardly concave surface against the incendiary material 18 when the seal ring 24 is installed into the jacket 12 so that no sharp breaks or corners are present against the incendiary material 18 to create a frictional pinching location during projectile assembly and during acceleration and spin up. The interior front collar portion 28 of the seal ring 24 is accordingly sized to frictionally conform to the projectile jacket 12 interior profile and still maintain a smooth contour after insertion.

The ring 24 is designed to be installed within the jacket 12 after the incendiary material 18 is deposited in the nose end of the jacket. It may be installed along with or prior to the insertion of the tubular hard metal body 14 containing the high explosive 20. The front collar portion 28 of the seal ring 24 has a maximum outer diameter greater than the inside diameter of the jacket so that it flexibly engages with the inner wall surface of the jacket 12 during seal insertion to scrape or swab any residual incendiary material from the wall to ensure that there is no incendiary present on the wall when the penetrator 14 is inserted into the jacket 12. Thus, all of the residual incendiary material is moved to the proper forward location during assembly.

The front collar portion 28 is short enough in length so that the material of the collar uniformly deforms and does not wrinkle when it is compressed and constricted to conform to the inner wall surface of the jacket 12. The rear skirt portion 30 is sized slightly larger than the collar portion 28 and has a maximum outer diameter greater than the inside diameter of the jacket 12 so as to act like a shuttle cock during seal insertion. This shape maintains the seal ring 24 in proper axial alignment. The rear portion 30 is also provided with cutout portions 36 to form segments to avoid wrinkling and/or unwanted material thickening when it is constricted during insertion. The interior of the rear portion 30 is also sized to fit around the front end of the penetrator 14. The rear skirt portion 30 is ultimately swaged between the tubular metal body of the penetrator 14 and the jacket 12 to seal this interface. The curved lip 34 extends over the front end of the penetrator 14 so that the seal ring 24 presents a smooth contoured surface 38 in contact with the rear of the nose incendiary charge 18.

Finally, a central bore 40 through the seal ring 24 permits an interface between the incendiary 18 and the high explosive charge 20 to maintain continuity of the explosive train. The size of bore 40 may be varied to control the detonation efficiency by providing greater or lesser confinement of the high explosive.

The base plug 16 preferably has a central blind bore 42 which contains a portion of the high explosive charge 20. This arrangement facilitates disintegration of the base plug upon explosive detonation. The base plug is preferably made of sintered zirconium so that it fragments into many burning particles upon detonation. In addition, the base plug 16 has an outwardly and forwardly flared front portion 44 which engages a tapered rear portion 46 of the tubular penetrator 14 so as to interlock the base plug 16 and penetrator 14 together.

The interface between the high explosive charge 20 and the incendiary charge 18 may be a flat transverse surface or preferably is a recessed, stepped surface 48 as shown in FIG. 1. Such a recessed, stepped surface 48 presents a large surface area contact between the high explosive and the incendiary for efficient detonation.

Assembly of the projectile 10 starts with the formation of the jacket 12. Then, the nose incendiary 18 is deposited in the nose of the jacket 12. The seal ring 24 may be installed next. The seal ring 24 is basically a swab to clean any residual incendiary material from the jacket as the seal or swab is passed through the jacket and lodged against the incendiary charge. Then the penetrator 14, base plug 16, high explosive 20, and lead seal 22 are assembled together and then installed so that the forward end of the penetrator 14 butts against the flat rear of the curved lip 34 of the seal ring 24. The rear portion 30 is swaged between the penetrator 14 and the jacket 12. Alternatively, the seal ring 24 may be installed on the front end of the penetrator assembly first and then both inserted together into the jacket 12.

If the penetrator has a recessed front surface as shown in Figure the recessed surface 46 may be filled with a partial charge of incendiary material prior to installation of the penetrator 14 in the jacket 12. The rest of the incendiary material will already have been installed in the jacket as just described. In this case the seal ring 24 is preferably installed on the front end of the penetrator assembly containing the high explosive and the partial incendiary charge and then installed within the jacket 12. The collar portion wipes or scrapes the inside of the jacket clean of incendiary material as it is inserted. Finally, the jacket 12 is crimped over the rear of the lead seal 22 to complete the assembly of the projectile 10.

As can readily be seen from the sectional views of FIGS. 1 and 2, any relative movement between the penetrator 14 and the jacket 12 during acceleration or spin up in the weapon bore will not involve contact with the incendiary to cause premature detonation of the high explosive because of the presence of the seal ring 24. This ring thus cushions the penetrator and partitions and prevents any contact between the incendiary and the front end of the penetrator. Further, the seal will desensitize the round to rough handling and dropping.

The seal ring 24 preferably has a relatively large central bore 40 therethrough so that the incendiary 18 has direct contact with the high explosive 20. In some applications, however, it may be desirable to restrict the size of the bore to provide a greater initial confinement of the high explosive hence, more efficient detonation. The detonation efficiency may be controlled by an appropriate choice of seal ring bore size.

The seal ring 24 is preferably made of a highly moldable material such as low density polyethylene. A highly combustible material such as a moldable nitrocellulose material may also be used which can minimize the parasitic mass in the projectile.

The installed seal ring 24 also prevents particles of incendiary material from lodging between the front end of the penetrator and the jacket during storage, transport, and handling. This can substantially reduce the probability of ignitions due to mishandling and dropping the rounds. Further, the seal permits a more severe taper at the front end of the penetrator than would otherwise be permitted, as shown in FIG. 2, which may be advantageous against some armor targets.

While the invention has been described above with reference to specific embodiments thereof, it is apparent that many changes, modifications and variations can be made without departing from the inventive concept disclosed herein. For example, the penetrator may be solid or tubular and the projectile may or may not contain a high explosive charge. The seal ring 24 may or may not have cutouts in the collar portion to prevent wrinkling as in the rear portion, thus allowing the collar portion to be longer, extending further between the incendiary 18 and the jacket 12 forward of the penetrator body 14.

Accordingly, it is intended to embrace all such changes, modifications and variations that fall within the spirit and broad scope of the appended claims. All patent applications, patents and other publications cited herein are incorporated by reference in their entirety.

What is claimed is:

1. A pyrotechnically initiated projectile comprising in coaxial alignment a nose incendiary charge, a hard metal penetrator body behind said charge having a front end, a metal jacket over said nose incendiary charge and said penetrator body, and a flexible swab means between said penetrator body and said incendiary charge over said front end, a portion of said flexible swab means extending between said jacket and said penetrator body in contact with said jacket, for scraping said jacket and precluding said incendiary charge from being positioned between said jacket and said penetrator body.

2. The projectile according to claim 1 wherein said flexible swab means comprises a flexible seal ring between said jacket and said body having a central portion, a resilient compressed front collar portion extending from said central portion forwardly between said charge and said jacket, and a rear resilient skirt portion extending from said central portion rearwardly between said jacket and said penetrator body.

3. The projectile according to claim 2 wherein said collar portion of said seal ring, when uncompressed, forwardly and outwardly diverges from said central portion in a flare which has an outer diameter greater than said jacket at a location adjacent said charge so that said collar is compressed against said jacket when said seal ring is installed inside said jacket and against said nose incendiary charge.

4. The projectile according to claim 2 wherein said central portion of said seal ring further comprises an inwardly directed circumferential lip engaging the front end of said penetrator.

5. The projectile according to claim 4 wherein said lip and said collar of said seal ring form a smooth contoured forward surface against said nose incendiary charge.

6. The projectile according to claim 2 further comprising said penetrator body having a tubular shape containing a high explosive charge.

7. The projectile according to claim 6, further comprising said central portion of said seal ring having a central bore therethrough providing an interface between said nose incendiary and said high explosive charge.

8. The projectile according to claim 1 wherein said penetrator body is a tubular penetrator having a high explosive charge therein communicating with said incendiary charge through a bore through said swab means.

9. The projectile according to claim 8 wherein said high explosive charge in said penetrator has a recessed forward surface interfacing with said incendiary charge.

10. The projectile according to claim 9 wherein said forward surface interfacing with said incendiary charge has a stepped shape.

11. The projectile according to claim 10 wherein said flexible swab means comprises a flexible seal ring between aid jacket and said penetrator body having a central portion, a resilient compressed front collar portion extending forwardly from said central portion between said charge and said jacket, and a rear resilient skirt portion extending from said central portion swaged rearwardly between said jacket and said penetrator body,

12. The projectile according to claim 11 wherein said collar portion of said seal ring, when uncompressed, forwardly and outwardly diverges from said central portion in a flare which has an outer diameter greater than said jacket at a location adjacent said charge so that said collar is compressed against said jacket when said seal ring is installed inside said jacket and against said nose incendiary charge.

13. The projectile according to claim 12 wherein said central portion of said seal further comprises an inwardly directed circumferential lip engaging the front end of said penetrator.

14. The projectile according to claim 13 wherein aid lip and said collar of said seal ring form a smooth contoured surface against said nose incendiary charge.

15. The projectile according to claim 1 further comprising a base plug coaxially arranged behind said penetrator.

16. The projectile according to claim 15 wherein said penetrator is a tubular body having its rear end interlocked with said base plug.

17. The projectile according to claim 16 wherein said penetrator body has a high explosive charge therein.

18. The projectile according to claim 17 wherein said high explosive charge has a recessed front end interfacing with aid incendiary charge.

19. The projectile according to claim 18 wherein said flexible swab means comprises a flexible seal ring between said jacket and said penetrator body having a central portion, a resilient front collar portion extending forwardly from said central portion between said charge and said jacket, and a rear resilient skirt portion extending from said central portion swaged rearwardly between said jacket and said penetrator body.

20. The projectile according to claim 19 wherein said collar portion of said seal ring, when uncompressed, outwardly diverges from said central portion in a flare which has an outer diameter greater than said jacket at a location adjacent said incendiary charge so that said collar is compressed against said jacket when said seal ring is installed inside said jacket and against said nose incendiary charge.

21. The projectile according to claim 20 wherein said central portion of said seal ring further comprises an inwardly directed circumferential lip engaging the front end of said penetrator.

22. The projectile according to claim 21 wherein said lip and said collar of said seal ring form a smooth contoured surface against said nose incendiary charge.

23. The projectile according to claim 22 wherein said central portion has a central bore therethrough providing an interface between said nose incendiary charge and a high explosive charge within said penetrator body.

24. The projectile according to claim 23 wherein said skirt portion has at least one cutout portion forming at least two spaced segments to help preclude wrinkling of the skirt portion during insertion of the seal inside the jacket of the projectile.

25. The projectile according to claim 24 wherein said collar portion, when uncompressed, forwardly and outwardly diverges from said central portion in a flare which has an outer diameter greater than said jacket at a location adjacent said charge so that said collar is compressed against said jacket when said seal is installed inside said jacket and against said nose incendiary charge.

26. The projectile according to claim 25 wherein said skirt portion has a greater maximum outer diameter than said collar portion.

27. A pyrotechnically initiated armor penetrating projectile comprising: a metal jacket, a penetrator body within the metal jacket, a pyrotechnic material within a front portion of the jacket and a resilient swab over a front end of said penetrator body and between said penetrator body and said jacket, said resilient swab being in contact with said jacket.

28. A pyrotechnically initiated armor penetrating projectile comprising: a metal jacket, a tubular penetrator body within the metal jacket, a pyrotechnic material within a front portion of the jacket and a resilient swab extending forwardly between said material and said jacket from a central portion over a front end of said penetrator and rearwardly swaged between a front end of the penetrator body and the jacket.

29. The projectile of claim 28 wherein the swab is behind a rear periphery of the pyrotechnic material, whereby to prevent the material from moving to a position between the body and the jacket.

* * * * *

UNITED STATES PATENT AND TRADEMARK OFFICE

CERTIFICATE OF CORRECTION

PATENT NO. : 5,133,259

DATED : July 28, 1992

INVENTOR(S) : David K. Schluckebier

It is certified that error appears in the above—identified patent and that said Letters Patent is hereby corrected as shown below:

In column 7, at line 4, before "further" insert -- ring --.

In column 7, at line 7, after "wherein" delete "aid" and insert --said--.

In column 7, at line 22, after "with" delete "aid" and insert --said--.

Signed and Sealed this

Fourteenth Day of September, 1993

Bruce Lehman

*Attest:*

BRUCE LEHMAN

*Attesting Officer*

*Commissioner of Patents and Trademarks*